US006363924B1

(12) United States Patent
Adams, Jr.

(10) Patent No.: US 6,363,924 B1
(45) Date of Patent: Apr. 2, 2002

(54) ARROW REST

(76) Inventor: Charles C. Adams, Jr., P.O. Box 30480, Jackson, WY (US) 83001

( * ) Notice: Subject to any disclaimer, the term of this patent is extended or adjusted under 35 U.S.C. 154(b) by 0 days.

(21) Appl. No.: 09/479,798

(22) Filed: Jan. 8, 2000

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,686,956 A * 8/1987 Troncoso ..... 124/44.5
4,827,895 A * 5/1989 Troncoso ..... 124/44.5
4,899,716 A * 2/1990 Martin et al. ..... 124/44.5
5,385,135 A * 1/1995 Saunders ..... 124/44.5
5,394,858 A * 3/1995 Karolian ..... 124/44.5
5,460,152 A * 10/1995 Specht ..... 124/44.5
5,603,309 A * 2/1997 Sheliga ..... 124/44.5

* cited by examiner

*Primary Examiner*—John A. Ricci
(74) *Attorney, Agent, or Firm*—Mallinckrodt & Mallinckrodt; Robert R. Mallinkrodt

(57) ABSTRACT

An arrow rest for use with archery bows includes an arrow supporting launcher that provides vertical movement to dampen any up and down movement of the arrow shaft when it is shot from the bow, such as up and down vibrational movement which occurs as a result of using a mechanical arrow release aid. The launcher includes a V-groove to support and guide the arrow. The rest also includes a pair of flippers which extend generally upwardly and in the direction of arrow travel along opposite sides of the arrow shaft supported on the launcher to lessen the chance that the arrow shaft will slide off the launcher. Either feature of the rest can be used alone without the other.

18 Claims, 3 Drawing Sheets

Figure 2:
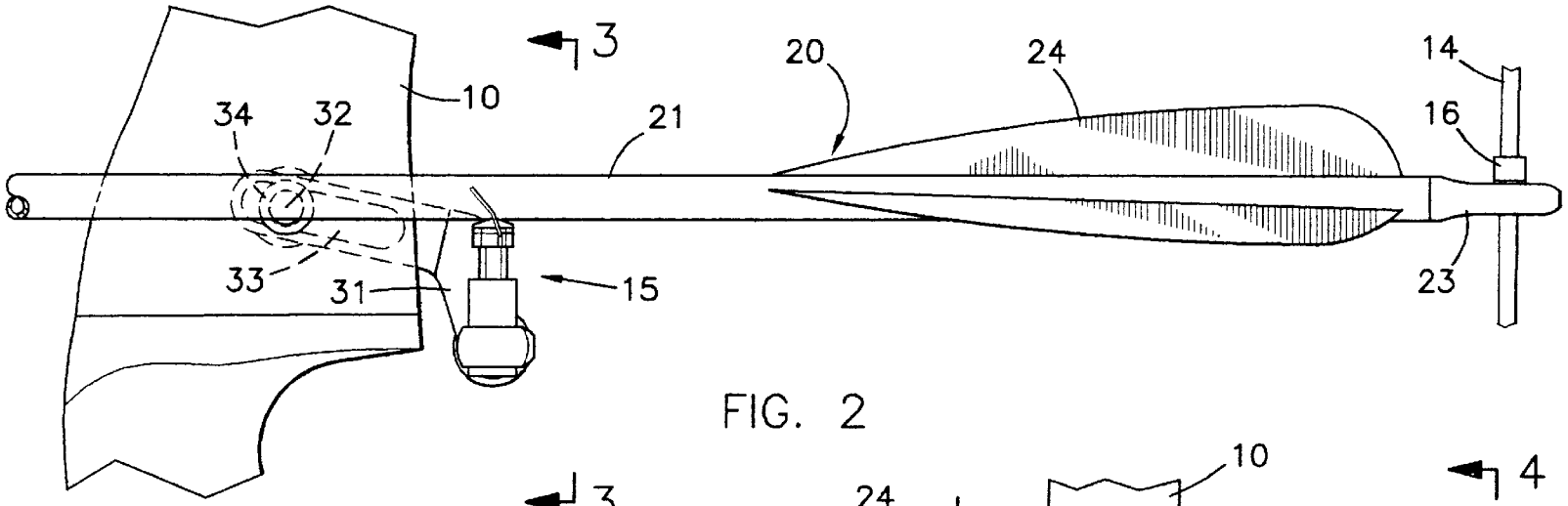

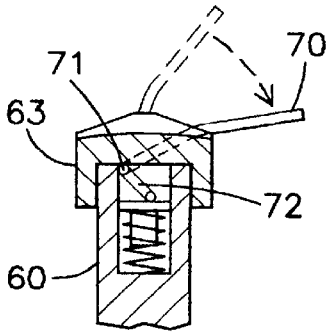
FIG. 7A
FIG. 8
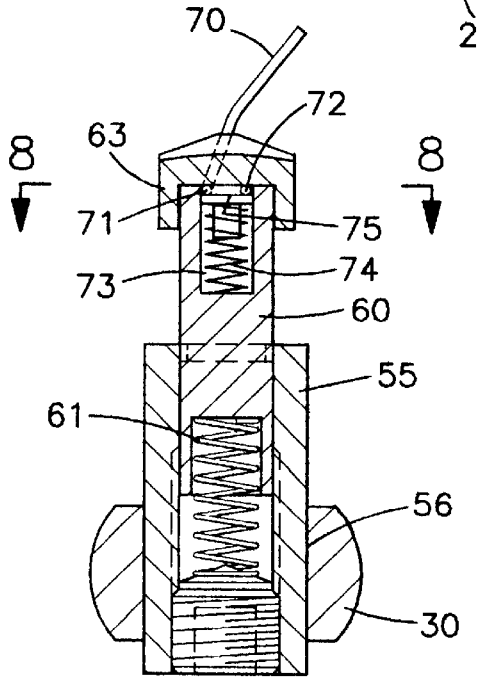
FIG. 7
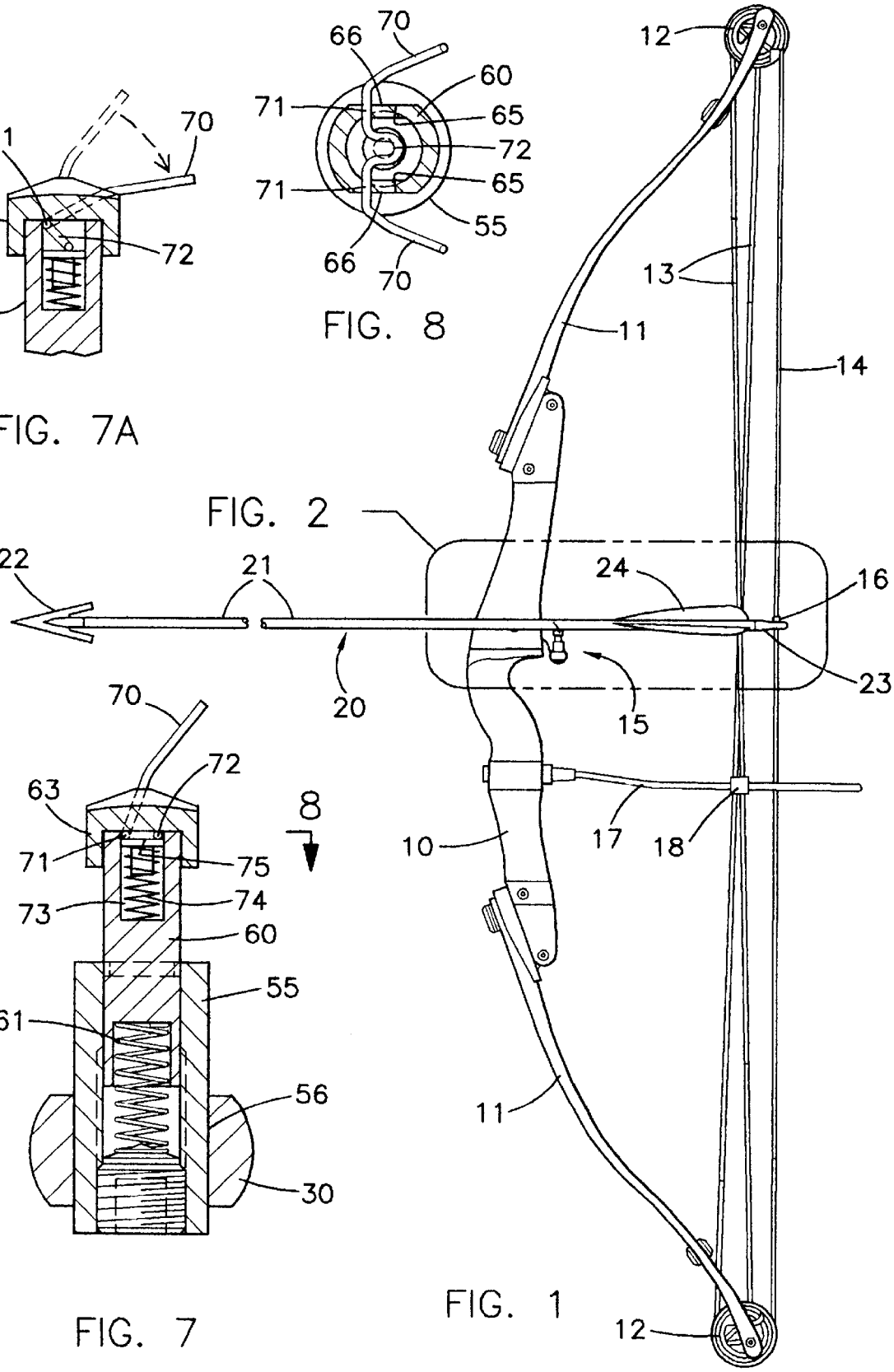
FIG. 1

ARROW REST

BACKGROUND OF THE INVENTION

1. Field

The invention is in the field of arrow rests for attachment to archery bows.

2. State of the Art

Arrow rests are generally used by archers to support an arrow during nocking of the arrow in an archery bow and such rests support the arrow as it is launched from the bow. The rest is attached to the archery bow riser and extends therefrom to support the arrow.

In shooting an archery bow, the archer will nock an arrow to the bowstring and place the arrow on an arrow rest. The archer may grip the arrow nock and bowstring and draw the string to drawn position. The forward portion of the arrow is supported on the arrow rest. The archer aims the bow, and then releases the string and arrow to shoot the bow and launch the arrow. When released, it has been found that an arrow will oscillate from side to side in a predictable manner as it passes over the arrow rest and leaves the bow.

Rather than holding the nock and string to draw the bow, the nock of the arrow can be held by a mechanical release device or release aid. The archer holds the mechanical release device using a hand grip portion of the device, draws and aims the bow, and operates the release device to release the arrow and bowstring to shoot the bow. It has been found that when an arrow is released by a mechanical release device, the arrow shaft vibrates unpredictably in an up and down, vertical motion, as opposed to the side-to-side oscillation when released by hand.

There are numerous arrow rests currently available to archers, some of which are designed specifically for use in connection with the hand release of arrows and some designed specifically for use with the mechanical release devices. Others can be used with either. Ideally, an arrow rest should support and guide an arrow during its movement and should allow free passage of arrow vanes without hitting the rest. If arrow vanes (arrow fletching) hit the rest as the arrow passes over the rest, accurate flight of the arrow may be interfered with. Some arrow rests have a small arrow supporting surface that does not interfere with passage of the arrow vanes. Such rests are good for use in target shooting and provide excellent accuracy with a well-tuned bow. However, such rests do not operate as well for hunting because the arrows can easily fall off such rests. During hunting, an arrow may be placed on the rest, but the hunter will continue to move around some in getting into final shooting position before actually shooting the bow. Rests designed to better hold the arrows on the rest do not have the same accuracy, particularly for hunting, because the larger fletching used with the larger hunting arrows has a tendency to hit the rest which interferes with straight arrow flight.

There is a continuing search for an arrow rest providing good accuracy and ease of holding an arrow in place.

SUMMARY OF THE INVENTION

According to the invention, an arrow rest, particularly for use with mechanically released arrows, includes a launcher which supports the arrow shaft and which is vertically cushioned to dampen up and down vertical vibration of a mechanically released arrow. The rest also includes upwardly extending flippers on either side of the launcher, but spaced to clear an arrow shaft properly resting on the launcher, to hold an arrow nocked in a bow using the rest, from easily falling off the launcher. While the combination of the vertically cushioned launcher and the side flippers provides a particularly good arrow rest for hunters using mechanical release aids, either of the features of the invention, the vertically cushioned launcher or the side flippers, can be used alone in an arrow rest to provide those particular features and advantages of the invention.

THE DRAWINGS

Figure 3:
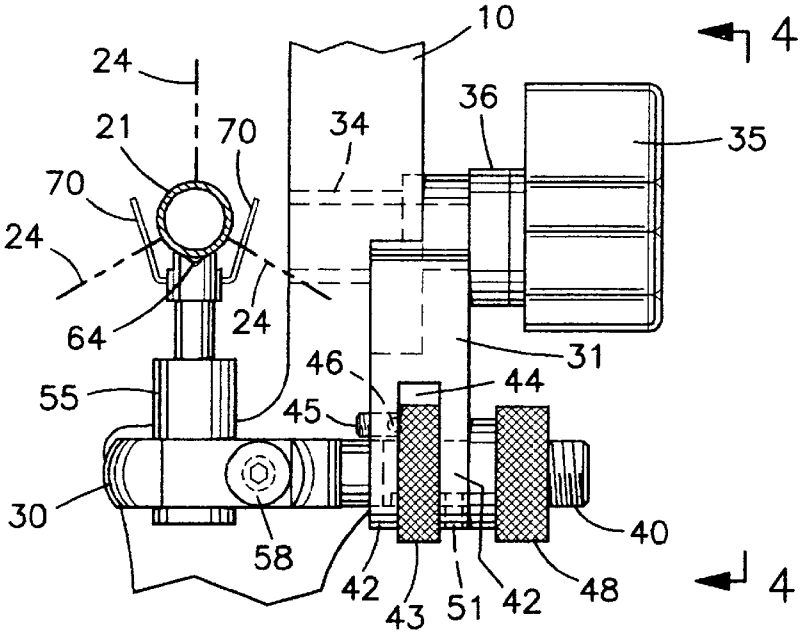
Figure 6:
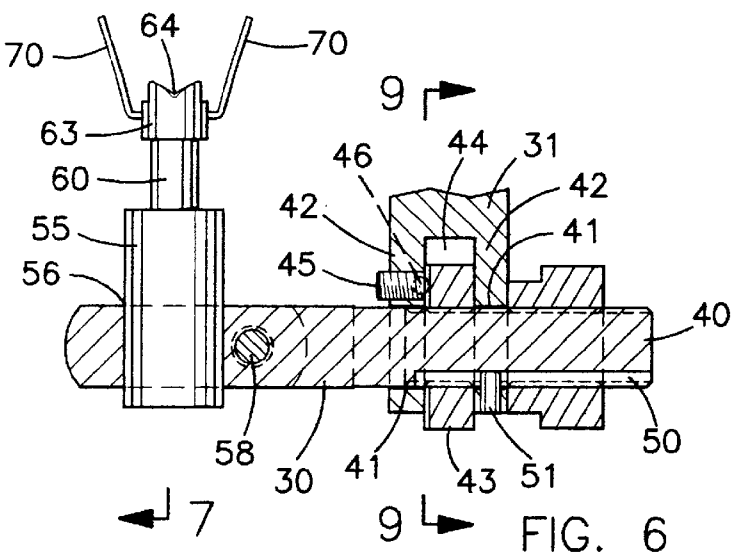
Figure 5:
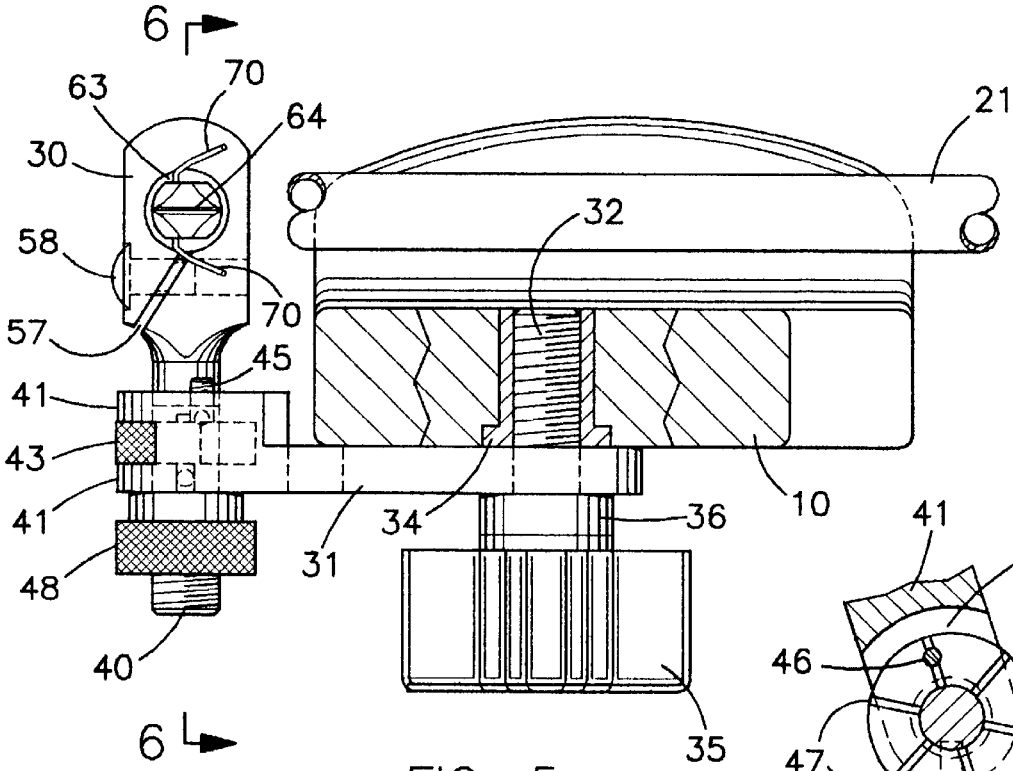
Figure 9:
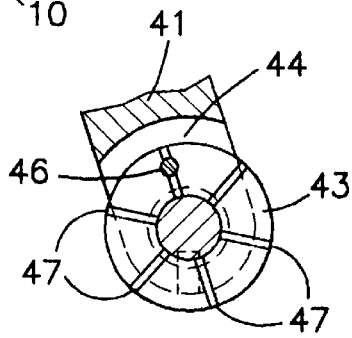
Figure 4:
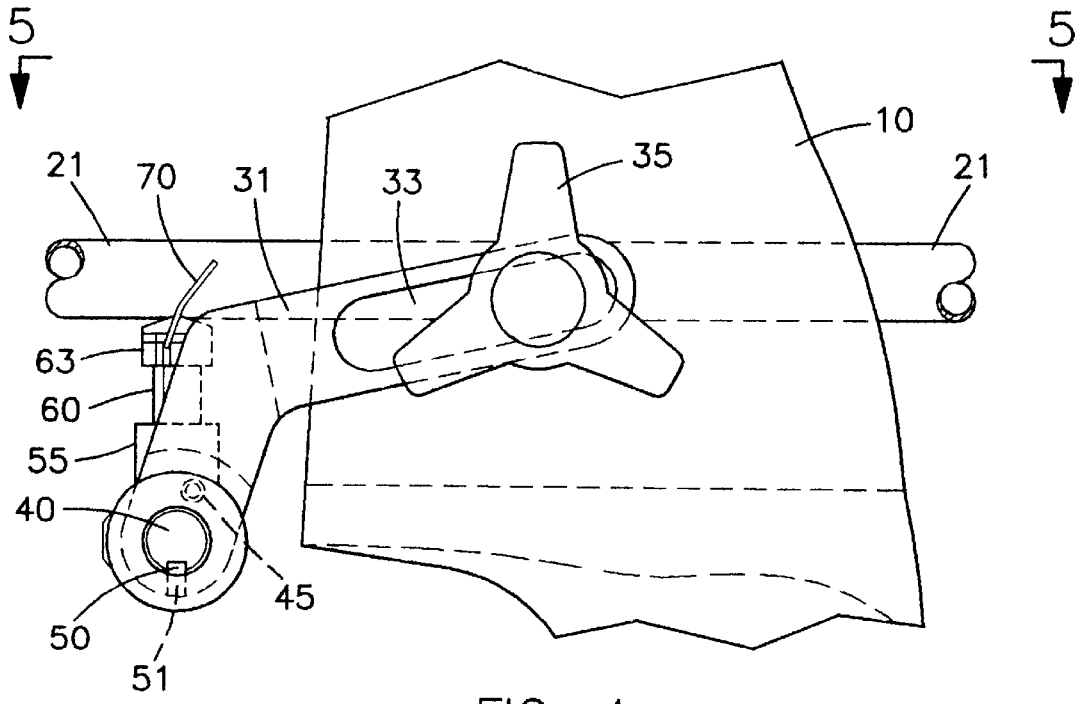

The best mode presently contemplated for carrying out the invention is illustrated in the accompanying drawings, in which:

FIG. 1 is a side elevation of an archery bow with an arrow rest of the invention mounted thereto;

FIG. 2, an enlarged, fragmentary elevation of that part of FIG. 1 encircled by the line labeled FIG. 2 in FIG. 1;

FIG. 3, a fragmentary vertical elevation take on the line 3—3 of FIG. 2;

FIG. 4, a fragmentary vertical elevation taken on the line 4—4 of FIG. 3;

FIG. 5, a top plan view of the rest taken on the line 5—5 of FIG. 4;

FIG. 6, a vertical section taken on the line 6—6 of FIG. 5 and rotated ninety degrees counter clockwise;

FIG. 7, a vertical section taken on the line 7—7 of FIG. 6;

FIG. 7*a*, a fragmentary vertical section showing the top portion of FIG. 7 with the flippers in a different position;

FIG. 8, a horizontal section taken on the line 8—8 of FIG. 7, but with the piston cap removed; and FIG. 9, a vertical section taken on the line 9—9 of FIG. 6.

DETAILED DESCRIPTION OF THE ILLUSTRATED EMBODIMENTS

A typical compound archery bow is shown in FIG. 1. The bow includes a handle riser 10 with limbs 11 extending from the ends thereof. Wheels 12 are eccentrically mounted at the outer ends of limbs 11 with cables 13 and bowstring 14 extending between the wheels. An arrow rest 15 of the invention is mounted in normal position on handle riser 10 and a nock locator in the form of a clamp on metal ring 16, is secured to the bowstring 14. A cable guide 17 extends from handle riser 10 with a cable retaining member 18 slidable mounted thereon. In use, an arrow 20 is placed on the arrow rest and the arrow is nocked on the bowstring 14 immediately below the nock positioning ring 16. Ring 16 ensures that the arrow is nocked in the same position on the bowstring each time. Arrow 20 includes arrow shaft 21, hunting broadhead arrowhead 22, nock 23, and fletching 24.

The arrow rest of the invention is particularly suited for use with mechanical release devices. In the use of such mechanical release devices, which are well known and therefore not shown here, an archer attaches such mechanical release device to the nock 23 of arrow 20. The archer then draws the bow with the mechanical release device held in normal manner for the particular device used, aims the bow, and shoots the bow by operating the release device to release the arrow and bowstring.

The arrow rest of the invention includes a base 30, secured to handle riser 10 by mounting bracket 31. Mounting bracket 31 is secured to handle riser 10 by screw 32 which extends through slot 33 in bracket 31 and is threaded into standard threaded receiving insert 34 normally provided in bow handle risers. Screw 32 has a large head 35 which can be easily grasped by a user for turning the screw and carries washer 36 thereon to bear against bracket 31. Bracket 31 is adjustably secured to handle riser 10 by loosening screw 32, sliding bracket 31 by means of slot 33 along screw 32 to desired position, and tightening screw 32 to secure bracket 31 to handle riser 10 in that position. In this manner, the vertical position and the extent to which the rest extends toward the archer from riser 10 may be adjusted. Base 30 may be rigidly mounted to bracket 31 and may be integral therewith, if desired, but it is preferred that base 30 be adjustably mounted to bracket 31 so the position of the rest can be adjusted horizontally with respect to riser 10. For this purpose, base 30 includes a threaded stud 40 forming one end thereof which passes through nonthreaded receiving holes 41 in bracket arms 42 of bracket 31. Knurled nut 43 is threaded onto stud 40 and is positioned in opening 44 formed between bracket arms 42. The width of nut 43 is such that nut 43 substantially fills space 44 so that it cannot move laterally within space 44. In this way, as nut 43 is rotated on stud 40, stud 40 and base 30 move laterally (horizontally) with respect to bracket 31, and with bracket 31 secured to riser 10, with respect to riser 10. A screw 45 with spring loaded ball 46 in the end thereof is threaded into one of the arms 42 so that ball 46 is biased against a side face of nut 43. Nut 43 includes a plurality of radial grooves 47, FIG. 9, spaced around that side face which cooperate with ball 46 to provide adjustment stops for nut 43. The six radial grooves shown in FIG. 9 provide six stops or detents for each revolution of nut 43. A knurled end nut 48 is threaded onto the end of stud 40 and is tightened against arm 42 to tighten and thereby secure the adjustment of nut 43 and the horizontal adjustment of base 30. To ensure that nuts 43 and 48 rotate with respect to stud 40 rather than merely rotating stud 40, stud 40 includes longitudinal slot 50 therein, FIGS. 4 and 6, which cooperates with screw 51 extending through arm 41 to prevent stud 40 from rotating.

The launcher assembly includes launcher cylinder 55 mounted to and extending upwardly from base 30. Launcher cylinder 55 may be fixed to base 30 and integral therewith, if desired, but is preferably adjustably secured to base 30. For this purpose, launcher cylinder 55 is received in receiving hole 56 of base 30, FIGS. 6 and 7. Base 30 is slotted as at 57, FIG. 5, so that it can be tightened by screw 58 about cylinder 55 to securely hold it in base 30. In this way, the vertical positioning of cylinder 55 with respect to base 30, and thus with respect to riser 10, can be adjusted.

Launcher piston 60 is slidably secured in launcher cylinder 55. Launcher piston 60 is biased upwardly by spring 61 in cylinder 55. In order to make spring 61 removable and changeable, plug 62 is threaded into threaded end of cylinder 55 opposite the end from which piston 60 extends. By removing plug 62, spring 61 can be removed from inside cylinder 55 and can be replaced.

A cap 63 is secured to the upper end of launcher piston 60 and includes a V-groove 64, FIGS. 3, 5, and 6, which receives arrow shaft 21 therein as shown in FIG. 3. The V-groove makes the illustrated launcher a V-groove launcher. When using a groove in the launcher to support the arrow shaft it is important to keep the groove aligned in the direction of arrow travel as the arrow is shot from the bow. To keep the alignment, launcher piston 60 should not be able to rotate in cylinder 55. As shown in FIG. 8, piston 60 has two opposite flat sides 65 which are held by flat sides 66 in the opening in the top of cylinder 55 through which launcher piston 60 extends.

As can be seen, launcher piston 60 can move up and down. Downward movement is against the bias of spring 61 and movement upwardly is with the bias of spring 61. Spring 61 has to be strong enough to support the weight of arrow shaft 21 resting thereon. However, the downward vibrational movement of the arrow when it is shot and moves over the arrow rest should be followed, cushioned, and dampened by the launcher. Thus, the strength of the spring 61 should be chosen to achieve such purpose. Arrows used in archery vary in their weight. Arrow shafts are available in various weights and various broadhead arrowheads have different weights. Fletching weight will vary with broadhead and arrow shaft weight to maintain a desired balance of the arrow. Further, heaver draw weight bows generally will require heavier weight arrows. This is the reason to make it so that spring 61 can be changed. Springs of appropriate weight for arrows being used can then be used with the rest. It has been found that the rest works well if the spring is chosen so that there is substantially no spring deflection when the arrow rests on the launcher. Further, it has been found that good results are obtained if the spring strength is such that deflection starts at a downward force applied to the launcher of about four times the weight of the arrow used. Thus, if a four hundred grain weight (one ounce) arrow is used, the spring should be chosen so that deflection starts at an applied force of about sixteen hundred grains (about four ounces). If a six hundred grain (one and one-half ounce) arrow is used, the spring should be chosen so that deflection starts at about twenty-four hundred grains (about six ounces). Various weight springs can be provided with the rest when sold such as light, medium, and heavy weight springs. The user can then use the spring that best approximately matches the arrows to be used.

It should also be noted, see FIG. 3, that the width of the top of the launcher with the groove is narrow so the it supports the arrow shaft but does not extend into the path of the arrow fletching when an arrow passes over the launcher. For three vane arrows, as shown, the arrow is arranged so the vertical vane extends upwardly on top of the arrow. With four vane arrows, the arrows are arranged so that none of the vanes extend vertically so that they do not hit the launcher support surface.

While the V-groove holds the arrow shaft 21 received therein against horizontal movement, the holding properties of such groove, while generally satisfactory for target shooting, are not generally satisfactory for hunting purposes. To improve the holding properties of the rest and to better hold the arrow shaft received in the groove of the launcher in the groove of the launcher, a pair of flippers 70 are provided with one flipper of the pair located on each opposite side of the launcher and the arrow shaft. The flippers could be mounted independently on the base 30 and extend upwardly therefrom, but it is presently preferred to mount the pair of flippers on the launcher piston. Thus, as shown, the flippers 70 are mounted between the top of launcher piston 60 and piston cap 63. Further, while each of the flippers 70 could be separate and separately mounted, it is convenient to form the two flippers of a single length of wire which is bent as shown in FIG. 8 to provide the two flippers with a connecting length of wire between them forming a flipper base 71, FIGS. 7, 7A, and 8. The wire forming the flipper base has a loop 72 bent therein to provide a bias surface for biasing the loop 72 to a horizontal position shown in FIG. 7 with flipper arms extending generally upwardly and in the direction of arrow travel. Launcher piston 60 has a top bore 73 therein with spring 74 positioned therein. Washer 75 is mounted on top of spring 74 and is biased against flipper arm base 71 and loop 72. With loop 72 held in horizontal position against the cap 63 as shown in FIG. 7, the flipper arm extend generally upwardly and away from the bowstring as shown. If flipper arms 70 are rotated away from the bowstring in the direction of arrow travel as shown in FIG. 7A, and as will happen when hit by arrow fletching 24 as the arrow is shot from the bow, see FIG. 3, loop 72 will cause compression of spring 74 as shown in FIG. 7A. Spring 74 will thus cause flipper 70 to return to the position shown in FIG. 7 after any deflection. The strength of spring 74 can be chosen as desired to provide the desire resistance to movement of flippers 70. Generally this resistance to movement should be small since the purpose of flippers 70 is to hold the arrow shaft from sliding off of launcher groove 64 but to offer minimal resistance to the passage of the fletching over the launcher when the arrow is shot. Minimal resistance is require to keep flippers 70 in upwardly extended position against any side pressure applied by an arrow shaft tending to slide off the launcher and minimal resistance is desired when the flippers are hit by the fletching. For less resistance against the arrow fletching, flippers 70 can be coated with a low friction material such as TEFLON.

Flippers 70 should be configured so that they do not touch the arrow shaft resting on the launcher. It is currently preferred to adjust the flippers to have between about one-thirty-second to about one-sixteenth inch clearance or gap between a side of an arrow shaft resting in the groove of the launcher and the flipper adjacent to that side of the shaft. The flippers will generally be configured to provide the desired clearance for most arrows as manufactured and sold, but the wire forming the flippers can be bent by a user to adjust for particular arrows to be used. The flippers should extend upwardly enough along the sides of the arrow shaft resting in the groove of the launcher to carry out the purpose of reducing the chance that the arrow shaft will slip off the launcher. It is presently preferred that the flippers be long enough to extend about to the top of an arrow shaft resting on the launcher or close to the top as shown in the drawings.

It has been found the vertical cushioning of the arrow as it passes over the arrow rest is an important feature of the invention. It should be noted that a rest which provides such cushioning is desirable, particularly for shooting with a mechanical release aid, and that, therefor, a rest providing such cushioning and damping can be used and is contemplated by the invention for use without use also of the flippers to provide additional holding of the arrow on the rest. Similarly, the flippers which reduce the chance of the arrow slipping off the top of the launcher can be used with various launchers and arrow rests other than the launcher described here.

While provision is made for various adjustments to be made to the rest described, such as vertical and horizontal positional adjustments, the arrow rest of the invention could be made without such adjustability. It is contemplated that various models of arrow rests of the invention will be offered, some with very limited adjustability.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An arrow rest for attachment to an archery bow, comprising:

a base;

means for attaching the base to an archery bow;

a launcher extending substantially vertically from the base for supporting an arrow shaft nocked in the bow; and a cylinder and piston assembly for vertically cushioning the launcher.

2. An arrow rest according to claim 1, wherein the launcher has a top surface with an arrow shaft receiving groove in the top surface.

3. An arrow rest according to claim 2, wherein the arrow receiving groove is a V-groove.

4. An arrow rest according to claim 3, additionally including a pair of flippers extending on opposite sides of the launcher and positioned to help hold an arrow shaft resting on the launcher from sliding off the launcher.

5. An arrow rest according to claim 4, wherein the flippers are carried by and move up and down with the launcher.

6. An arrow rest according to claim 5, wherein the flippers are secured together and move together.

7. An arrow rest according to claim 6, wherein the flippers are formed of a length of wire with a flipper base portion connecting the flippers.

8. An arrow rest according to claim 7, wherein the flippers extend upwardly approximately to the top of the arrow shaft.

9. An arrow rest for attachment to an archery bow, comprising:

a base;

means for attaching the base to an archery bow;

a launcher extending substantially vertically from the base for supporting an arrow shaft nocked in the bow; and a cylinder and piston assembly wherein the piston moves in the cylinder to vertically cushion the launcher.

10. An arrow rest according to claim 9, wherein a spring in the cylinder biases the piston vertically upwardly.

11. An arrow rest according to claim 10, wherein the piston has a top surface with an arrow shaft receiving groove in the top surface.

12. An arrow rest according to claim 11, wherein the arrow receiving groove is a V-groove.

13. An arrow rest according to claim 12, additionally including a pair of flippers extending on opposite sides of the launcher and positioned to help hold an arrow shaft resting on the launcher from sliding off the launcher.

14. An arrow rest according to claim 13, wherein the flippers are carried by and move up and down with the piston.

15. An arrow rest for attachment to an archery bow, comprising:

a base;

means for attaching the base to an archery bow;

an arrow shaft support; and a pair of flippers pivotally secured to the arrow shaft support to extend on opposite sides of the arrow shaft support and biased to a normal holding position extending above the arrow shaft support to help hold an arrow shaft resting on the arrow shaft support from sliding off the arrow shaft support, but allowing the flippers to pivot from holding position in relation to the arrow shaft support if hit by arrow fletching during use of the arrow rest.

16. An arrow rest according to claim 15, wherein the flippers are secured together and move together.

17. An arrow rest for attachment to an archery bow, comprising:

a base;

means for attaching the base to an archery bow;

an arrow shaft support; and a pair of flippers extending on opposite sides of the arrow shaft support and biased to a normal holding position extending above the arrow shaft support to help hold an arrow shaft resting on the arrow shaft support from sliding off the arrow shaft support, wherein the flippers are secured together and move together and wherein the flippers are formed of a length of wire with a flipper base portion connecting the flippers.

18. An arrow rest according to claim 17, wherein the flippers extend upwardly approximately to the top of the arrow shaft.

* * * * *